US006084353A

United States Patent [19]

Bohlen

[11] Patent Number: 6,084,353

[45] Date of Patent: Jul. 4, 2000

[54] COAXIAL INDUCTIVE OUTPUT TUBE HAVING AN ANNULAR OUTPUT CAVITY

[75] Inventor: Heinz Bohlen, Mountain View, Calif.

[73] Assignee: Communications and Power Industries, Inc., Palo Alto, Calif.

[21] Appl. No.: 08/868,194

[22] Filed: Jun. 3, 1997

[51] Int. Cl.[7] ..... H01J 25/08

[52] U.S. Cl. ..... 315/5.32; 315/5.37

[58] Field of Search ..... 315/4, 5, 5.32, 315/5.37

[56] References Cited

U.S. PATENT DOCUMENTS

| | | | |
|---|---|---|---|
| 2,119,565 | 6/1938 | Williams et al. . | |
| 2,122,538 | 7/1938 | Potter . | |
| 2,164,922 | 7/1939 | Hollmann . | |
| 2,176,589 | 10/1939 | Hollmann . | |
| 2,220,922 | 11/1940 | Trevor . | |
| 2,225,447 | 12/1940 | Haeff et al. | 315/5.14 |
| 2,233,126 | 2/1941 | Haeff | 315/3.6 |
| 2,254,096 | 8/1941 | Thompson . | |
| 2,289,846 | 7/1942 | Litton | 315/5.37 X |
| 2,299,792 | 10/1942 | Bouwers et al. . | |
| 2,408,409 | 10/1946 | Bowen | 315/5 |
| 2,409,224 | 10/1946 | Samuel | 315/5 |
| 2,409,693 | 10/1946 | Okress . | |
| 2,413,276 | 12/1946 | Wolff | 315/378 X |
| 2,425,748 | 8/1947 | Llewellyn | 315/5.32 X |
| 2,466,067 | 4/1949 | Woodyard et al. | 315/39 X |
| 2,485,400 | 10/1949 | McArthur | 315/39 |
| 2,501,095 | 3/1950 | Record | 315/5.32 X |
| 2,514,925 | 7/1950 | Beggs | 315/39 |

(List continued on next page.)

FOREIGN PATENT DOCUMENTS

| | | | |
|---|---|---|---|
| 0 125 530 | 4/1984 | European Pat. Off. | H01J 25/04 |
| 0 587 481 A1 | 9/1993 | European Pat. Off. | H01J 25/04 |

OTHER PUBLICATIONS

Cuccia, et al., "The Electron Coupler—A Spiral–Beam UHF Modulator", Mar. 1950, Electronics, pp. 80–85.

Preist, et al., "The Klystrode—An Unusual Transmitting Tube with Potential for UHF–TV", Nov., 1982, IEEE, vol. 70, No. 22, pp. 1318–1325.

Preist, "Prospects for Very High Power High efficiency RF Generators", 1966, Conference on Microwave and Optical Generation and Amplification (MOGA),pp. 146–150.

Faillon, G., "Revue Technique Thomson–CSF", vol. 23, No. 4, Dec. 1991, pp. 809–815.

Gilmour, A. S. Jr., "Microwave Tubes", Artech House, Proceedings IEEE, Nov. 1982, pp. 196–197.

Preist, et al., "The Klystrode–An Unusual Transmitting Tube with Potential for UHF–TV", Proceedings of The IEEE, vol. 70, No. 11, Nov. 1982, pp. 1318–1325.

Zinchenko, et al., "A Three–Electrode High–Perveance Electron Gun For Defining A Tubular Beam", Institute of Radio Physics and Electronics, Academy of Sciences of the Ukrainian SSR, Khar'kov, No. 5, Sep.–Oct. 1974, Original Article Submitted Nov. 4, 1973, pp. 1263–1265.

*Primary Examiner*—Benny T. Lee

*Attorney, Agent, or Firm*—D'Alessandro & Ritchie

[57] ABSTRACT

An Inductive Output Tube where, in order to permit the use of coaxial output cavities, the electron beam propagates in first approximation in a radial direction from the cathode. The electron beam is generated by an in first approximation cylindrical cathode, and gated by a consequently in first approximation cylindrical grid. The required drive power is provided by a coaxial input circuit. Depending on the level of a bias voltage, $V_g$, applied between grid and cathode, the radial electron beam can optionally be operated in modulation classes A, AB, B or C. The modulated electron beam, accelerated by the beam voltage applied between cathode and anode, passes through an in first approximation cylindrical output gap where the modulation interacts with the electromagnetic field of a coaxial output circuit which is optionally connected to one or both ends of the gap between anode and collector. The spent beam is then collected by a radial collector. In this manner the desired use of coaxial cavities, operating in the suitable $TE_{011}$ coaxial mode, is achieved.

30 Claims, 6 Drawing Sheets

U.S. PATENT DOCUMENTS

| | | | |
|---|---|---|---|
| 2,546,993 | 4/1951 | Ferguson . | |
| 2,647,175 | 7/1953 | Sheer . | |
| 2,808,470 | 10/1957 | Hansell . | |
| 2,832,001 | 4/1958 | Adler | 315/3.6 |
| 2,835,844 | 5/1958 | McBride, Jr. | 315/5.32 X |
| 2,840,647 | 6/1958 | Koros et al. . | |
| 2,840,753 | 6/1958 | Dailey | 315/5.24 |
| 2,870,374 | 1/1959 | Papp | 315/39 |
| 2,917,712 | 12/1959 | Smith et al. | 330/56 |
| 2,958,804 | 11/1960 | Badger et al. | 315/5.39 |
| 3,022,443 | 2/1962 | Fowler | 315/39.3 |
| 3,159,803 | 12/1964 | Czubiak et al. . | |
| 3,305,752 | 2/1967 | Friz | 315/39 |
| 3,389,295 | 6/1968 | Pietrzyk | 315/39.3 |
| 3,614,518 | 10/1971 | Schmidt | 315/5.53 |
| 3,719,909 | 3/1973 | Hanft . | |
| 3,742,292 | 6/1973 | Gerlach et al. | 315/39 |
| 3,921,027 | 11/1975 | Shelton et al. | 315/5.39 |
| 3,950,710 | 4/1976 | Covington, Jr. | 330/49 |
| 3,971,966 | 7/1976 | Gottfried et al. | 315/39.3 |
| 4,119,921 | 10/1978 | Warringa et al. | 330/49 |
| 4,184,123 | 1/1980 | Grill et al. | 330/56 |
| 4,210,845 | 7/1980 | Lebacqz | 315/5.25 |
| 4,424,044 | 1/1984 | Pitman et al. | 445/35 |
| 4,520,293 | 5/1985 | Müller | 315/5.25 |
| 4,567,406 | 1/1986 | Heynisch | 315/5.33 |
| 4,988,878 | 1/1991 | VanZwienen | 250/397 |
| 5,682,084 | 10/1997 | Langlois et al. | 315/5.37 X |
| 5,698,949 | 12/1997 | Lien et al. | 315/5.37 X |

COAXIAL INDUCTIVE OUTPUT TUBE HAVING AN ANNULAR OUTPUT CAVITY

BACKGROUND OF THE INVENTION

1. Field of the Invention

This invention relates to the field of Inductive Output Tubes. More particularly, this invention relates to Inductive Output Tubes for use as amplifiers and oscillators having coaxial output circuits and therefore having an anode and a collector arranged radially about a central cathode.

2. The Background Art

A major limitation to the power output obtainable from a conventional power grid tube is the power that can be dissipated by the grids, screens and anodes of such conventional tubes. Too much power dissipated into a wire grid can cause premature failure of the tube. A. V. Haeff, et al.'s Inductive Output Tube (IOT), developed in the 1930s and described in U.S. Pat. No. 2,225,447, uses nonintercepting electrodes, such as apertures, rather than delicate wire grids by employing a magnetic field disposed coaxially with the electron beam. Power is removed from the bunched or density-modulated electron beam by passing the beam through a resonant cavity in which the kinetic energy of the electrons, previously accelerated to a high velocity, is converted to electromagnetic energy without the need to collect the electrons on the walls of the cavity.

Inductive output tubes are thus a special family of tubes similar to tetrodes. They differ from conventional gridded tetrodes mainly by the way the radio frequency (RF) output power is extracted from the modulated electron beam inside the tube. While in the conventional tetrode both the screen grid and the anode form parts of the RF output circuit, the IOT features an output cavity separated from any beam current gating or collecting electrodes. The electron beam in the IOT interacts with the output cavity solely via electromagnetic field components, as in a klystron. Thus the amplitude of the RF output voltage is no longer limited to the DC potential difference between anode and screen grid, eliminating the typical tetrode compromise between gain and output power. As a result the IOT becomes an amplifier tube superior to the tetrode especially at UHF frequencies (300–3000 MHz), providing higher gain, efficiency and output power in this frequency range.

FIG. 1 is a schematic diagram of an IOT 10 according to the prior art. Electrons 12 from a thermionic cathode 14 are emitted and controlled by a grid 16 closely spaced from the emitting surface of cathode 14. Grid 16 is biased with a DC grid bias relative to cathode 14 as shown. A magnetic field 18 surrounds the linear electron beam 12. An RF signal (RF IN) to be amplified is introduced through input port 20 to input cavity 22. Interaction between the RF input signal in input cavity 22 and the electron beam 12 results in density modulation of the electron beam 12. Electrons are accelerated by a relatively high voltage on anode 25. In output cavity 26 between the anode 25 and the tailpipe as shown the density modulated current induces an electromagnetic field resulting in output power available through output coupling 28 of output port 30. The electrons are ultimately collected by a collector in a conventional manner.

Accordingly, the IOT has been perceived as a linear electron beam tube. IOTs built to date are consequently all of the linear beam type, using electron guns, output cavities and collectors similar to those of klystrons. This linear structure creates certain disadvantages. The output cavities for such a linear beam design employ preferably the $TE_{101}$ mode (if rectangular) or the $TM_{011}$ mode (if circular), as in klystrons. This leads to fairly bulky amplifier assemblies, which become especially awkward in the case of IOT-equipped television transmitters, where two coupled output cavities are normally required in order to achieve the specified bandwidth (approximately 6 MHz). An IOT designed to operate in coaxial output cavities (like those commonly used for tetrodes operating in the same UHF frequency spectrum) would lead to an amplifier with a considerably smaller footprint, thereby reducing equipment and site costs.

Another disadvantage linked with prior art IOTs is that in order to limit the space charge in the electron beam to values which still support a reasonable efficiency, and to extract output power at the desired levels despite limited availability of effective cathode surface area, the operating voltage of linear beam IOTs has to be even higher than that of klystrons of similar output power. Such IOTs typically operate in the Television Service at a voltage potential of about 30 to 38 KV for a power output in the range of about 40 to 75 KW. This high voltage (H.V. also denoted "+" and "−" in FIG. 1 as shown) requirement results in increased equipment costs for power supplies due to a consequent requirement for higher voltage insulation and more X-ray shielding. Additional adverse effects of such high voltage operation include the difficulty in preventing high-voltage arcing across the DC insulation that is an integral part of the input circuit in IOTs and an increased danger of high voltage breakdown in the cavity due in part to the fact that the peak RF voltage in the output circuit is higher than the operating voltage of the tube, all of which limit both the useable output power of the tube and the physical elevation above sea level at which the tube can be operated (due to reduced air pressure and breakdown of air dielectrics at altitude), if external cavities are used as they are for television transmission.

Current commercial television operators seek increased power output capabilities for television transmitters operating in the UHF frequency spectrum. Such transmitters are often operated on mountain tops and other high altitude locations having reduced air pressure and air dielectric breakdown voltages. Because power, P, voltage, V and current, I are related by the expression P=VI, more power can be obtained by operating a linear beam IOT at high voltage. However, as noted above, this apparently simple expedient, when implemented in reduced air pressure environments, requires substantial additional expense in power supplies, insulation, and the like, and is, as a practical matter, difficult and expensive to do. Similarly, more power can be obtained by increasing the electron beam current of the IOT, however, this is also difficult to achieve with current linear beam devices due to the space charge problems discussed above.

Accordingly, there is a need for a higher power UHF electron device which can achieve such higher output power with higher currents rather than by resorting to increased voltage operation.

OBJECTS AND ADVANTAGES OF THE INVENTION

Accordingly, it is an object and advantage of the present invention to provide an improved electron device especially adapted for operation in the 300 MHz to 3000 MHz frequency range.

It is a further object and advantage of the present invention to provide an inductive output electron tube having a coaxial output.

It is a further object and advantage of the present invention is to provide an inductive output tube having a radial electron beam at the anode.

Yet a further object and advantage of the present invention is to provide an inductive output tube capable of higher current operation thus permitting high power operation at lower beam voltages.

These and many other objects and advantages of the present invention will become apparent to those of ordinary skill in the art from a consideration of the drawings and ensuing description of the invention.

SUMMARY OF THE INVENTION

The present invention is an Inductive Output Tube where, in order to permit the use of coaxial output cavities, the electron beam propagates in first approximation in a radial direction from the cathode. For this purpose the electron beam is generated by an in first approximation cylindrical cathode, and gated by an approximately cylindrical grid. The required drive power is provided by a coaxial input circuit. Depending on the level of a bias voltage, $V_g$, applied between grid and cathode, the radial electron beam can optionally be operated in modulation classes A, AB, B or C. The modulated electron beam, accelerated by the beam voltage applied between cathode and anode, passes through an approximately cylindrical output gap where the modulation interacts with the electromagnetic field of a coaxial output circuit which is optionally connected to one or both ends of the gap between anode and collector. The spent beam is then collected by a radial collector. In this manner the desired use of coaxial cavities, operating in the suitable $TE_{011}$ coaxial mode, is achieved. Compared to a linear beam configuration, this solution provides a considerably larger cathode surface, permitting much higher beam currents at a given voltage, or vice versa, permitting much lower voltage at a given beam power value. This radial beam approach also provides low space charge values in the radial electron beam. It also offers low RF voltage in the output cavity and low specific thermal loading in output cavity and collector. In addition, the lower beam impedance offers the potential of increased bandwidth.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

Figure 1:
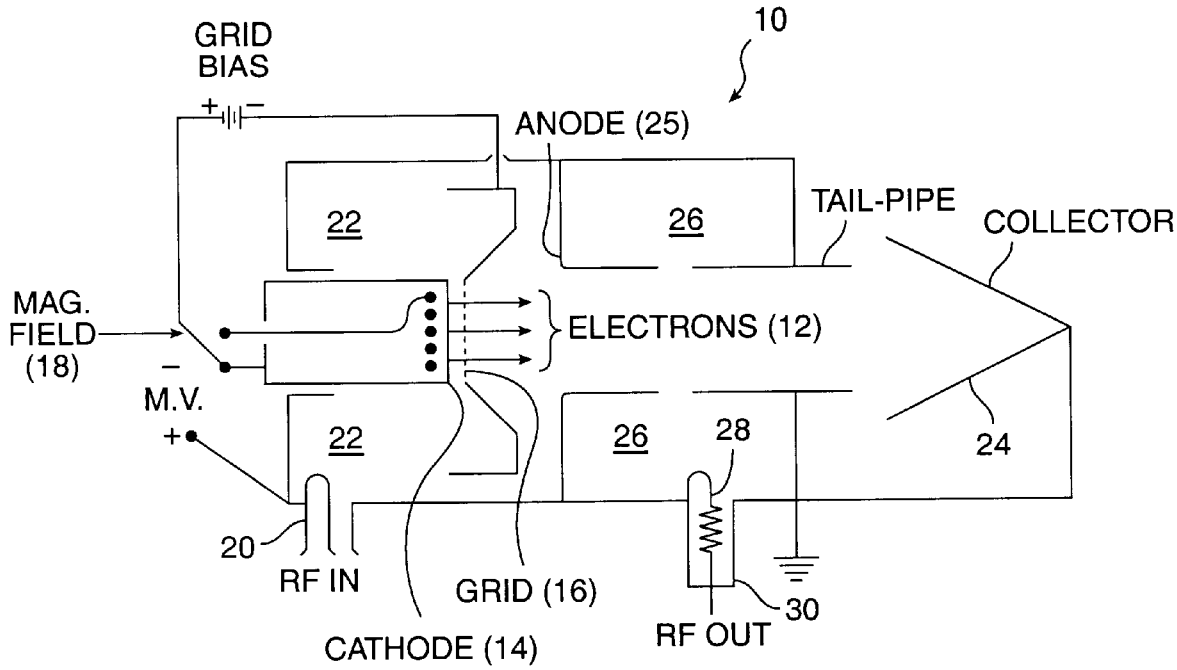
FIG. 1 PRIOR ART
FIG. 1 is a schematic diagram of an inductive output tube in accordance with the background art.
Figure 2:
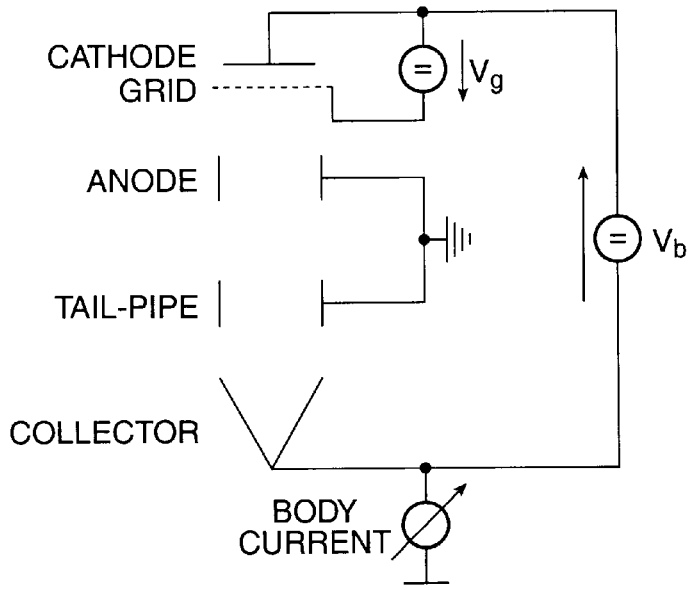
FIG. 2 PRIOR ART
FIG. 2 is an electrical schematic diagram of an inductive output tube in accordance with the background art.

The operation of the coaxial IOT is similar to that of the linear beam IOT in many ways. Turning to FIG. 2, an electrical schematic diagram of an IOT, drive power applied to the input circuit coupled to the grid as shown generates a radio frequency (RF) current in class A, AB, B or C, depending upon the value of the grid bias voltage, $V_g$. This current is accelerated by the beam voltage, $V_b$, between the cathode and anode as shown and the accelerated, modulated beam, and thereby inducing an electromagnetic field in the output circuit between the anode and the tailpipe as shown. The spent beam is dissipated in the collector assembly and any excess body current at the collector may be bled to ground as shown.

Figure 3:
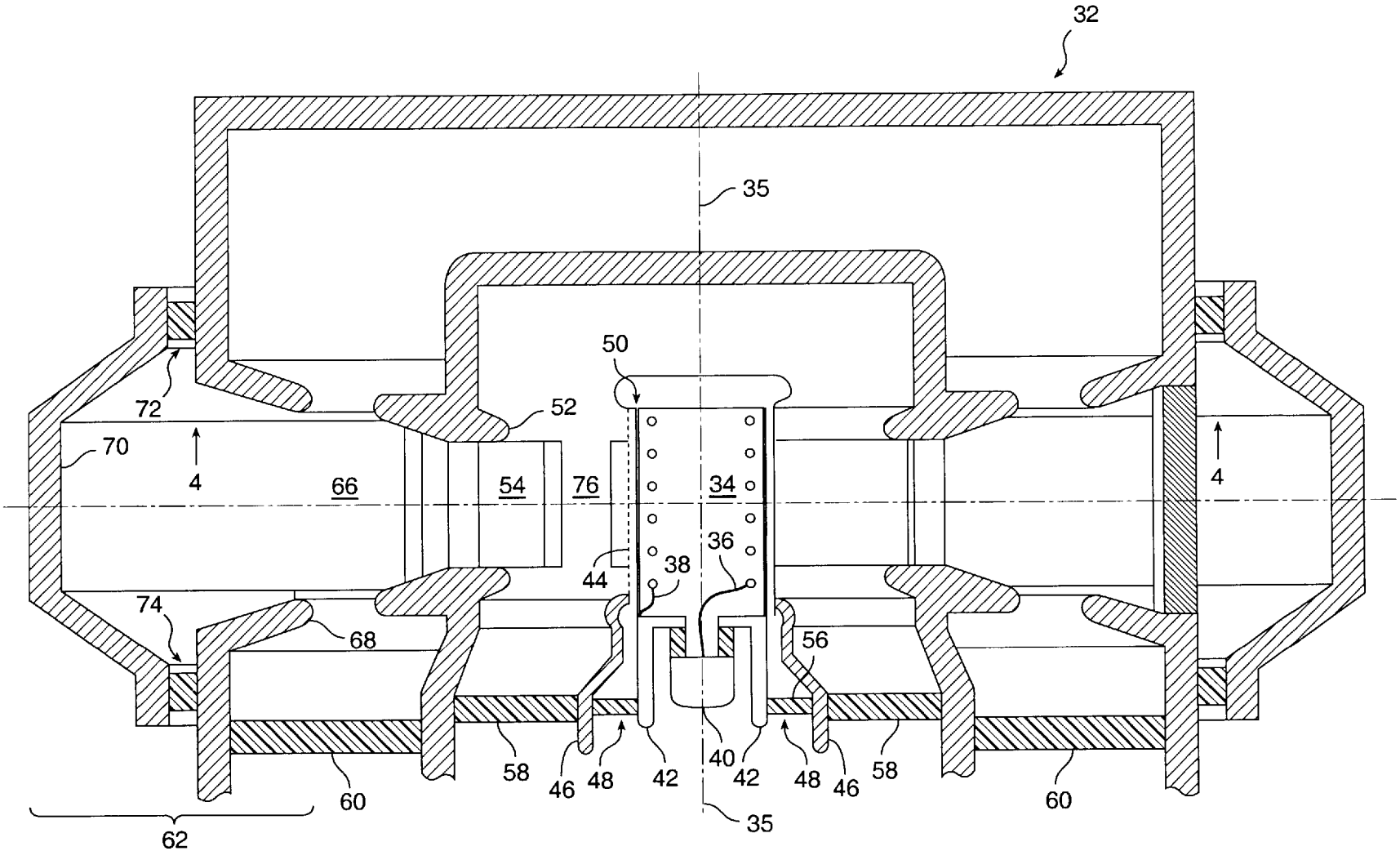
FIG. 3 is a cross sectional diagram of a first presently preferred embodiment of the present invention.
Figure 5:
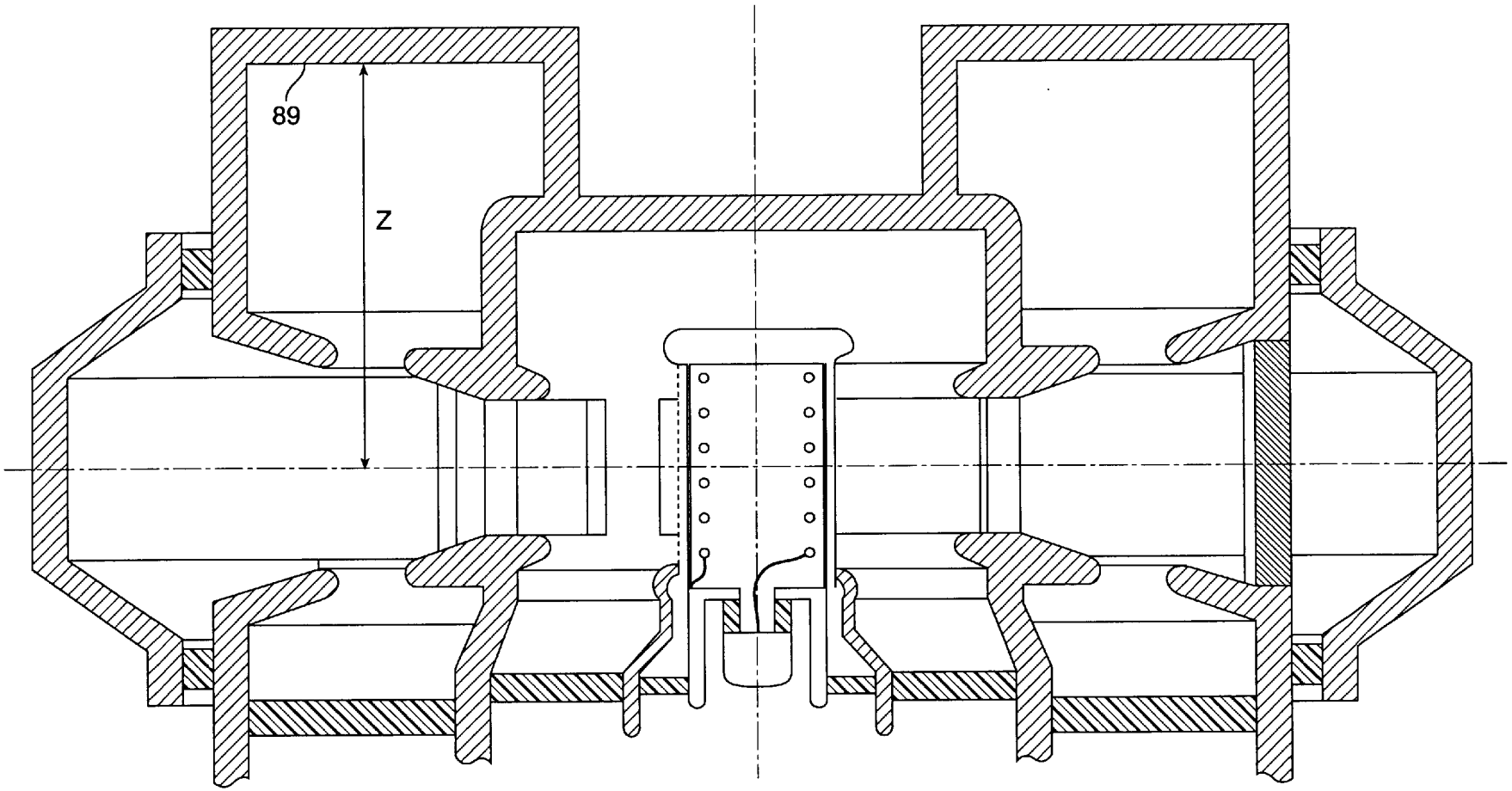
FIG. 5 is a cross sectional diagram of a second presently preferred embodiment of the present invention.
Figure 6:
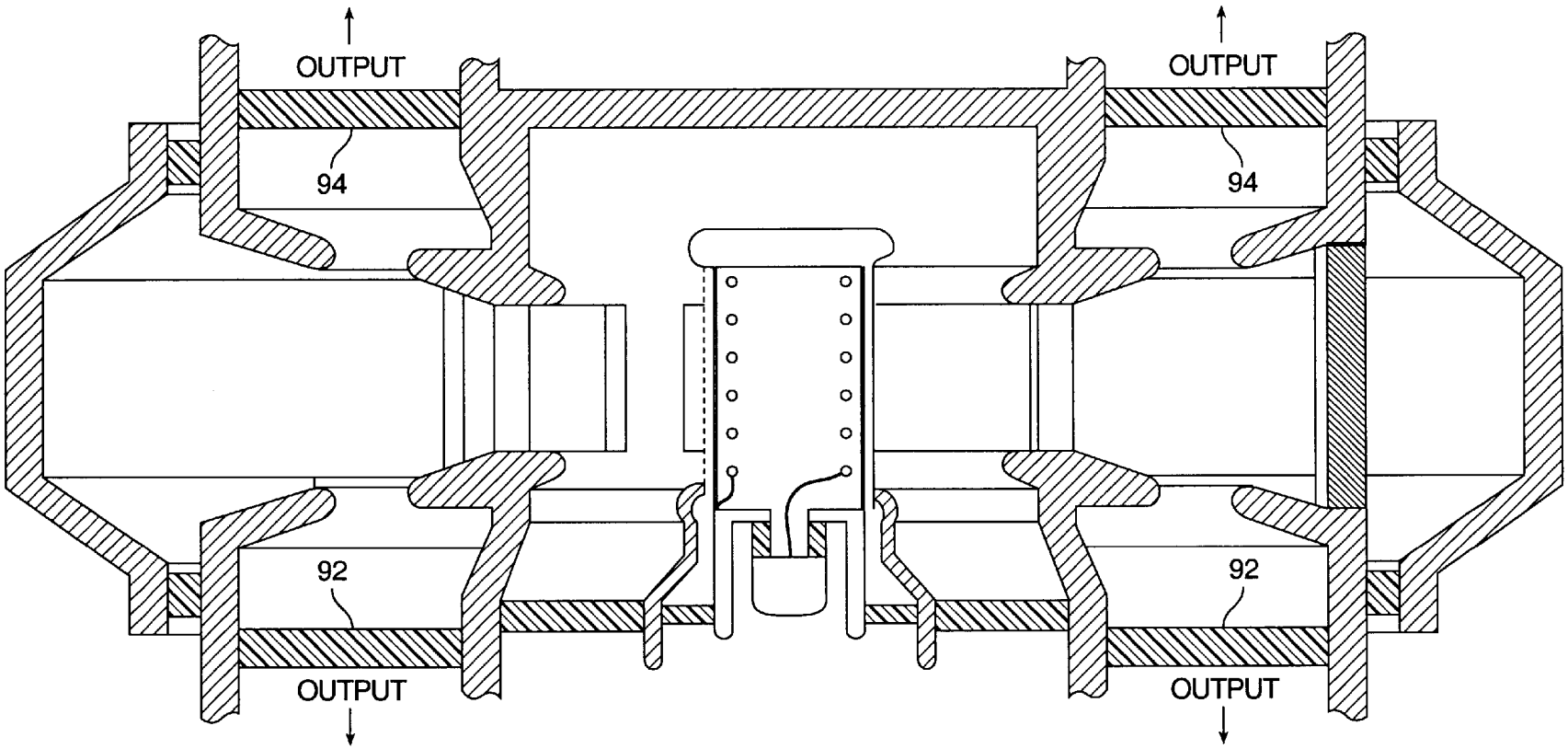
FIG. 6 is a cross sectional diagram of a third presently preferred embodiment of the present invention.
Figure 7:
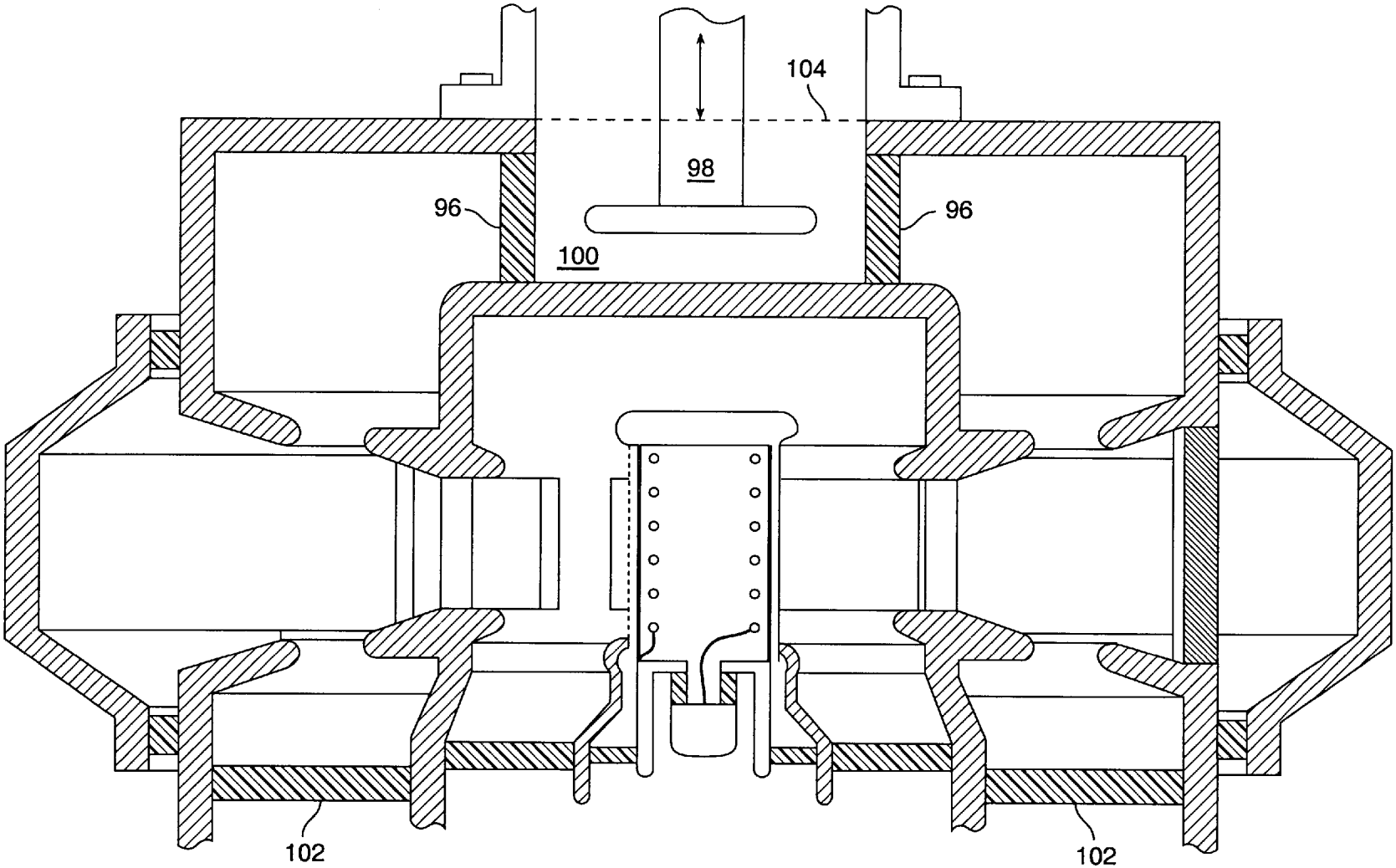
FIG. 7 is a cross sectional diagram of a fourth presently preferred embodiment of the present invention.

The principle presented in this disclosure can be used to design a variety of specialized tubes. The version shown in FIG. 3 is suitable for applications that require wide-band tunability at high frequencies. If tunability is not of the essence, a simplified version as shown in FIG. 5 can be used. FIG. 6 presents a version for lower frequencies, and FIG. 7 shows a high-power variation of this tube, featuring access for a coaxial output coupler directly to the tube rather than to the output cavity. In any case, these are only examples for the variety of possible versions of a radial electron beam coaxial IOT all of which share the same basic features of the invention. Many variations are likewise possible for details of each version, like grounded instead of insulated collectors, multi-stage collectors, means to suppress RF oscillation in or RF radiation from the grid/anode area, water-or air-cooling for collector or other parts of the tube, lay-out of the electrostatic focusing electrodes, possible electromagnetic or permanent magnetic focusing of the electron beam, position and connection of insulating ceramics and window ceramics, etc.

Not shown are the tube-external parts of the required coaxial circuits. The technology for these elements is generally known to those of ordinary skill in the art from coaxial cavities for high-power tetrodes; the main difference being that the high-voltage choke, in tetrode amplifiers part of the output cavity, becomes part of the input circuit in an IOT amplifier.

Turning now to FIG. 3, a metal ceramic coaxial inductive output tube 32 according to a first preferred embodiment of the present invention is depicted in cross section. Metal ceramic construction is presently preferred due to its ruggedness, relative replicability and high temperature capability. There is no requirement that the tube be built as a metal ceramic structure. As noted above, the embodiment shown in FIG. 3 is particularly well-suited to applications that require wide-band tunability at high frequencies (for instance, in a range of about 470 MHz to about 860 MHz as required for Television transmitters operating in the UHF Television Band). Thermionic cathode 34 is preferably a conventional, substantially cylindrical structure disposed about a central axis 35 of coaxial inductive output tube 32. Power is delivered to a heater (not shown—but internal to the cathode in a preferred embodiment) for exciting thermionic cathode 34 into electron emission over wires 36, 38 which are, in turn, connected respectively to conductive elements 40, 42.

A conventional substantially cylindrical grid structure 44 is disposed a distance from and coaxial with cathode 34. The cathode—grid gap or spacing follows conventional closely spaced design and is preferably in a range of about 0.15 mm to about 1.0 mm. Grid connections are made through conductor 46.

For amplifier operation, a conventional coaxial RF input connection is made to the RF input port 48. This RF input is applied to the region 50 between the cathode and the grid, thus modulating the emission of electrons in the amplifier in accordance with the input signal as discussed above.

An anode structure 52 is disposed radially about grid 44. In operation, anode 52 is held at a high potential. Electrons emitted from cathode 34 are accelerated in a direction substantially orthogonal (at right angles) to central axis 35 by the electric field caused by the high potential on anode 52 in the high voltage gap region 54. Gap region 54 is therefore radially disposed in anode 52. This causes an effect similar to that of conventional IOT electron "bunching" but it does so in a disk-shaped or radial beam form rather than in a linear beam form. Higher currents may thus be obtained without exceeding space charge limitations.

In FIG. 3 element 56 is an insulator, preferably alumina, beryllium oxide or other brazeable ceramic vacuum material which retains the high vacuum of tube 32 while permitting RF input signals to pass through it. Element 58 is a similar insulator which stands off the voltage difference between anode 52 and grid 44. RF window 60 is also an insulator which stands off the voltage difference between anode 52 and collector assembly 62 while permitting the output RF signal to pass through into an appropriate coaxial output interface (not shown).

The region 66 between anode 52 and collector assembly 62 is known as the "interaction gap." It is in this region that the density modulated electron current may interact electromagnetically with the coaxial output through RF window 60.

Collector assembly 62 may be a simple collector element held at a fixed potential, it may be a multi-stage collector of more than one element, each held at a fixed potential, it may be a multi-stage depressed collector, or it may be of any convenient design as known to those of ordinary skill in the art. Collector assembly 62 as shown is a two-stage collector having a first element 68, corresponding to the "tailpipe" of a linear beam IOT, preferably held at a first fixed potential equal to that of anode 52 and a second element 70 preferably held at a second fixed potential lower than that of first element 68. Element 70 is preferably (but not necessarily) electrically insulated from element 68 with ceramic spacers 72, 74.

Figure 4:
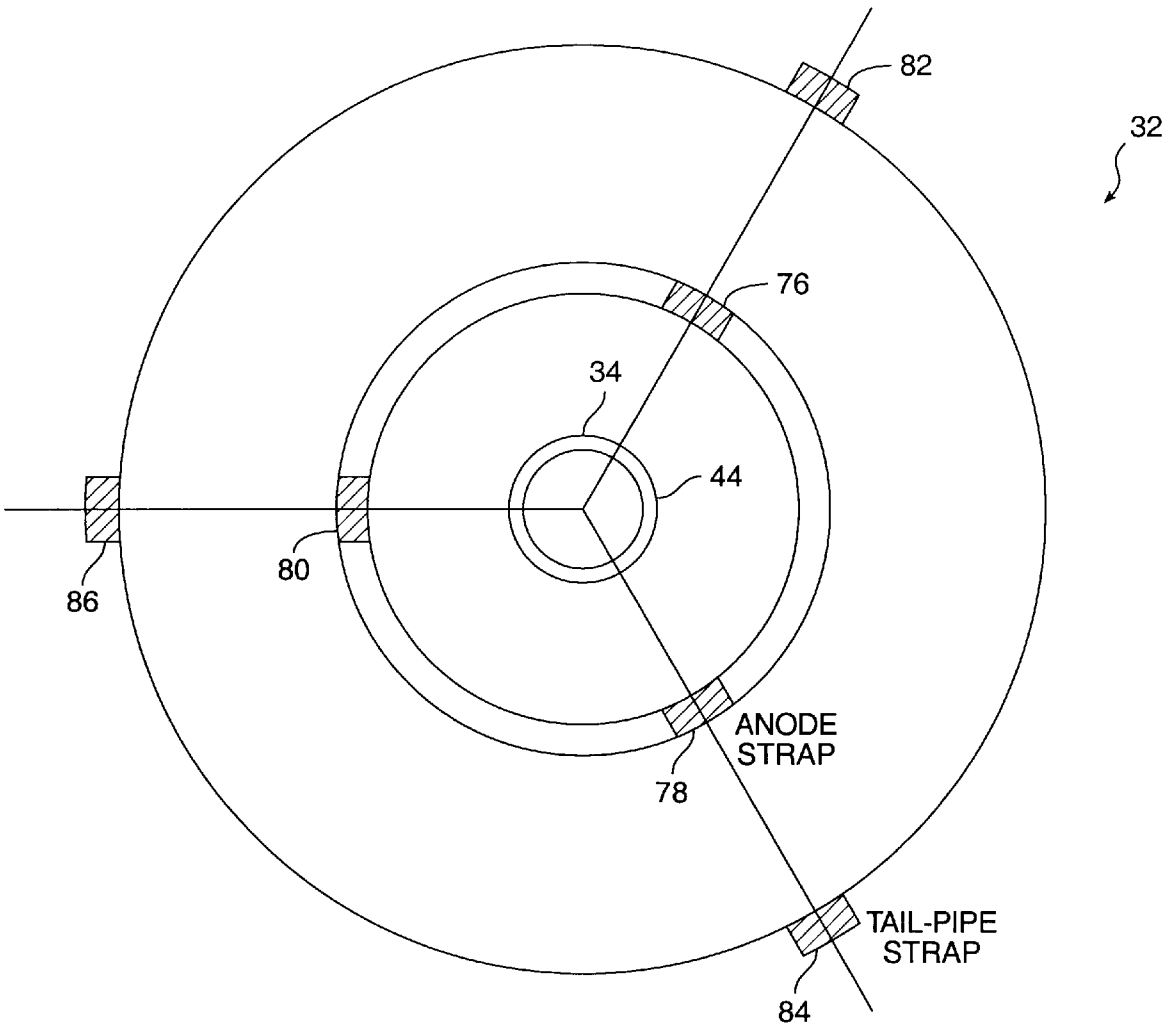
FIG. 4 is a cross sectional diagram taken along line 4—4 of FIG. 3.

Turning now to FIG. 4, a cross sectional view of coaxial IOT 32 is shown taken along line 4—4 of FIG. 3. As is clear from FIG. 3, anode straps 76, 78, 80 and tailpipe straps 82, 84, 86 which are preferably conductive members made of a material such as copper, are disposed so as to electrically connect or strap upper and lower elements of anode 52 and collector element 68. For example, anode 52 includes a top ring portion 88 and a bottom ring portion 90. These two elements are held apart yet are electrically connected to one another by anode straps 76, 78 and 80. By holding the two elements halves apart, a largely evacuated disk-shaped area is made available in which the radial beam of electrons may propagate relatively unimpeded from cathode 34 to second collector assembly element 70. Tailpipe straps 82, 84 and 86 perform a similar function with respect to elements of collector assembly 62, as shown.

These stops between anode sections and between tailpipe sections also prevent the coupling of RF energy in the output circuits into the collector or grid/anode space of the tube and also provide mechanical support and stability to the tube.

Turning now to FIG. 5, a version of the coaxial IOT is presented which is optimized for use with higher frequencies and where large range tuneability is not of the essence. In this version of the tube, the tube-internal part of the output cavity is short-circuited at conductive wall 89 a distance Z vertically from the horizontal plane at the center of the output gap. For optimal operation, $z=\lambda/4$ where $\lambda$ is the wavelength corresponding to the desired center operating frequency of the tube. This modification ensures that the beam interacts exactly, or at least approximately, with the maximum RF voltage in the output gap, thereby providing a maximum of output power and efficiency.

Turning now to FIG. 6, a coaxial IOT is presented which is tunable over a large frequency range while still maintaining the favorable condition of having only one short circuit at about $A\lambda/4$ distance from the interaction gap. For this purpose this version permits the use of a 2-segment coaxial output cavity and includes first coaxial output port 92 and second coaxial output port 94.

Turning now to FIG. 7, a relatively low frequency coaxial IOT version of the present invention possesses a cylindrical output window preferably formed of an insulator such as alumina which is gas tight to hold the vacuum of the tube, brazeable, and does not greatly attenuate the output frequency of the tube (in a frequency range where the distance between output coupler and interaction gap is considerably smaller than $A\lambda/4$. Cylindrical output window 96 permits the use of variable coaxial output coupler 98. Output coupler 98 may be moved in or out of cavity 100 to adjust output coupling between the load and the amplifier as desired in a conventional manner. In this version, there is a single output window 96 but additional secondary circuits may be coupled coaxially to the IOT at, for example, port 102. Also note that instead of cylindrical output window 96, one could substitute a conventional disk-type output window disposed at plane 104.

While illustrative embodiments and applications of this invention have been shown and described, it would be apparent to those skilled in the art that many more modifications than have been mentioned above are possible without departing from the inventive concepts set forth herein. Specifically, the collector assembly may be operated with or without insulation from the tailpipe and its own constituent pieces in a single or multi-stage configuration. Cooling elements have not been shown. Any kind of air, mixed phase or liquid type of cooling system may be used to carry away waste heat as required and well known to those of ordinary skill in the art. Likewise not shown are elements used to suppress RF generation in the grid/anode space. Such elements may be required in a particular tube design as is well known to those of ordinary skill in the art. Those of ordinary skill in the art will also realize that specific shapes and dimensions of tube parts will need to be adjusted to operate in a particular desired frequency and power range. The invention, therefore, is not to be limited except in the spirit of the appended claims.

What is claimed is:

1. An inductive output tube comprising:

a cathode disposed about a first axis of the tube;

a grid disposed apart from said cathode and about said first axis;

an anode disposed apart from said grid and about said first axis, said anode having a radially disposed gap for allowing a density modulated stream of electrons emitted from said cathode and modulated by said grid to travel in paths approximately orthogonal to said first axis;

a collector assembly disposed to receive electrons passing through said radially disposed gap;

an interaction gap disposed between said collector assembly and said anode, said interaction gap receiving said density modulated stream of electrons;

a cavity coaxial with said first axis, said cavity electromagnetically coupled to said interaction gap;

an output coupling window through which RF energy is electromagnetically coupled, said output coupling window in the shape of an annular ring surrounding said cathode and said anode and coaxial with said first axis; and an output coupler adjacent to said output coupling window disposed along said first axis for adjusting coupling between said inductive output tube and a load coupled to said inductive output tube.

2. An inductive output tube according to claim 1, wherein said cathode is approximately cylindrical in shape.

3. An inductive output tube according to claim 1, wherein said cavity is approximately torroidal in shape.

4. An inductive output tube according to claim 1, wherein said cavity further comprises a conductive outer wall located a fixed distance Z from a first orthogonal plane, said first orthogonal plane being orthogonal to said first axis and said distance Z being of a value which is substantially one quarter wavelength at a selected operating center frequency of the tube.

5. An inductive output tube according to claim 1, wherein said output coupling window is comprised of an insulating material.

6. An inductive output tube according to claim 5, wherein said insulating material is comprised of alumina.

7. An inductive output tube according to claim 1, wherein said output coupler is approximately cylindrical in shape.

8. An inductive output tube according to claim 1, wherein said output coupling window is approximately cylindrical in shape.

9. An inductive output tube according to claim 8, wherein said output coupler is approximately cylindrical in shape.

10. An inductive output tube according to claim 1, wherein said output coupler is adjustable along said first axis.

11. An inductive output tube comprising:

a cathode disposed about a first axis of the tube;

a grid disposed apart from said cathode and about said first axis;

an anode disposed apart from said grid and about said first axis, said anode having a radially disposed gap for allowing a density modulated stream of electrons emitted from said cathode and modulated by said grid to travel in paths approximately orthogonal to said first axis;

a collector assembly disposed to receive electrons passing through said radially disposed gap;

an interaction gap disposed between said collector assembly and said anode, said interaction gap receiving said density modulated stream of electrons;

a cavity coaxial with said first axis, said cavity electromagnetically coupled to said interaction gap;

an output coupling window through which RF energy is electromagnetically coupled, said output coupling window cylindrical in shape and defining an interior cavity, said output coupling window disposed about said first axis; and a variable output coupler adjacent to said inner cavity defined by said output coupling window and disposed along said first axis, for adjusting coupling between said inductive output tube and a load coupled to said inductive output tube.

12. An inductive output tube according to claim 11, wherein said cathode is approximately cylindrical in shape.

13. An inductive output tube according to claim 11, further comprising:

a secondary output coupling window through which said RF energy is electromagnetically coupled, said output coupling window in the shape of an annular ring surrounding said cathode and said anode and coaxial with said first axis.

14. An inductive output tube according to claim 11, wherein said cavity is approximately torroidal in shape.

15. An inductive output tube according to claim 11, wherein said outer wall of said cavity is located a fixed distance Z from a first orthogonal plane, said first orthogonal plane being orthogonal to said first axis and said distance Z being of a value which is substantially one quarter wavelength at a selected operating center frequency of the tube.

16. An inductive output tube according to claim 11, wherein said output coupling window is comprised of an insulating material.

17. An inductive output tube according to claim 16, wherein said insulating material is comprised of alumina.

18. An inductive output tube, comprising:

a cathode disposed about a first axis of the tube;

a grid disposed about said cathode;

an anode disposed about said grid, said anode having a radially disposed gap for allowing a density modulated stream of electrons emitted from said cathode and modulated by said grid to travel in paths approximately orthogonal to said first axis;

a collector assembly disposed to receive electrons passing through said radially disposed gap;

an interaction gap disposed between said collector assembly and said anode, said interaction gap receiving said density modulated stream of electrons;

an output port in said interaction gap, said output port including a non-inductive window;

a cavity coaxial with said first axis, said cavity electromagnetically coupled to said interaction gap;

an output coupling window through which RF energy is electromagnetically coupled, said output coupling window in the shape of an annular ring surrounding said cathode and said anode and coaxial with said first axis; and an output coupler adjacent to said output coupling window disposed along said first axis for adjusting coupling between said inductive output tube and a load coupled to said inductive output tube.

19. An inductive output tube according to claim 18, wherein said collector assembly includes at least one element, said at least one element being held at a voltage potential different from a voltage potential that is held at said anode.

20. An inductive output tube according to claim 19, further comprising a heater disposed inside said cathode.

21. An inductive output tube according to claim 18, further comprising a heater disposed inside said cathode.

22. An inductive output tube comprising:

a cathode disposed about a first axis of the tube;

a grid disposed apart from said cathode and about said first axis;

an anode disposed apart from said grid and about said first axis, said anode having a radially disposed gap for allowing a density modulated stream of electrons emitted from said cathode and modulated by said grid to travel in paths approximately orthogonal to said first axis;

a collector assembly disposed to receive electrons passing through said radially disposed gap;

an interaction gap disposed between said collector assembly and said anode, said interaction gap receiving said density modulated stream of electrons;

a first cavity coaxial with said first axis, said first cavity electromagnetically coupled to said interaction gap;

an output coupling window through which RF energy is electromagnetically coupled, said output coupling window in the shape of an annular ring surrounding said cathode and said anode and coaxial with said first axis; and an output coupler for adjusting coupling between said inductive output tube and a load coupled to said inductive output tube, said output coupler disposed adjacent to said output coupling window, along said first axis and within a second cavity.

23. An inductive output tube according to claim 22, wherein said first cavity is approximately torroidal in shape.

24. An inductive output tube according to claim 22, wherein said cavity further comprises a conductive outer wall located a fixed distance Z from a first orthogonal plane, said first orthogonal plane being orthogonal to said first axis and said distance Z being of a value which is substantially one quarter wavelength at a selected operating center frequency of the tube.

25. An inductive output tube according to claim 22, wherein said output coupling window is approximately cylindrical in shape.

26. An inductive output tube according to claim 22, wherein said output coupling window is comprised of an insulating material.

27. An inductive output tube according to claim 26, wherein said insulating material is comprised of alumina.

28. An inductive output tube according to claim 22, wherein said output coupler is approximately cylindrical in shape.

29. An inductive output tube according to claim 22, wherein said cathode is approximately cylindrical in shape.

30. An inductive output tube according to claim 22, wherein said output coupler is adjustable along said first axis within said second cavity.

* * * * *

UNITED STATES PATENT AND TRADEMARK OFFICE

CERTIFICATE OF CORRECTION

PATENT NO: 6,084,353
DATED: July 4, 2000
INVENTOR(S): Heinz Bohlen

It is certified that error appears in the above-identified patent and that said Letter Patent are hereby corrected as shown below:

In column 1 line 58 delete "collector" and insert - - collector 24- -.

In column 3 line 14 delete "an in first approximation cylindrical" and insert - - an approximately cylindrical- -

In column 5 line 44 delete "FIG. 3" and insert - - FIGS. 3 and 4- -.

In column 6 line 11 delete "Aλ/4" and insert - -λ/4- -.

In column 6 line 22 delete "Aλ/4" and insert - - λ/4)- -.

Signed and Sealed this

Tenth Day of April, 2001

*Attest:*

Nicholas P. Godici

NICHOLAS P. GODICI

*Attesting Officer*

*Acting Director of the United States Patent and Trademark Office*